United States Patent [19]

Emilson

[11] 4,319,767

[45] Mar. 16, 1982

[54] HEEL BINDING FOR CROSS-COUNTRY SKIS

[76] Inventor: Carl G. Emilson, Box 214, Cohasset, Mass. 02025

[21] Appl. No.: 138,173

[22] Filed: Apr. 7, 1980

[51] Int. Cl.[3] ..... A63C 9/086

[52] U.S. Cl. ..... 280/614; 280/634

[58] Field of Search ..... 280/611, 614, 615, 618, 280/619, 623, 633, 634

[56] References Cited

U.S. PATENT DOCUMENTS

| | | | |
|---|---|---|---|
| 3,702,194 | 11/1972 | Iizuka et al. | 280/633 |
| 3,931,981 | 1/1976 | Sittmann | 280/623 |
| 4,261,595 | 4/1981 | Smialowski et al. | 280/627 |

FOREIGN PATENT DOCUMENTS

| | | | |
|---|---|---|---|
| 692466 | 5/1940 | Fed. Rep. of Germany | 280/619 |
| 1032054 | 6/1953 | France | 280/623 |

*Primary Examiner*—Joseph F. Peters, Jr.
*Assistant Examiner*—Donald W. Underwood
*Attorney, Agent, or Firm*—Morse, Altman, Oates & Dacey

[57] ABSTRACT

A binding is provided for use primarily on cross-country skis, which binding is adapted to selectively control the boot with respect to the ski and allow the boot and ski to function in one of the several different modes. Attached to the heel of the boot is a plate that is formed with a rearwardly facing vertical groove and indent located along the groove. Mounted directly behind the boot on top of the ski is a multi-position mechanism having a plunger adapted to engage, partially engage or fully disengage the plate on the boot. Thus, by appropriately positioning the plunger, the boot may be held immobile against the ski, allowed to move only vertically at the heel or to be entirely free and clear at the heel.

14 Claims, 8 Drawing Figures

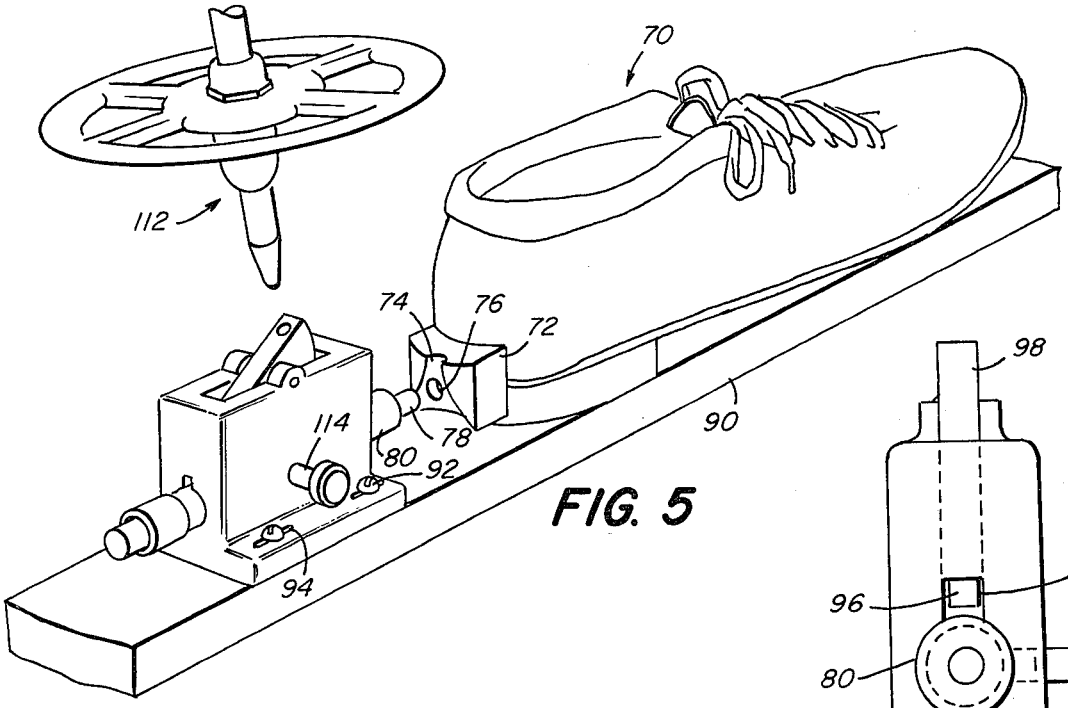
FIG. 5
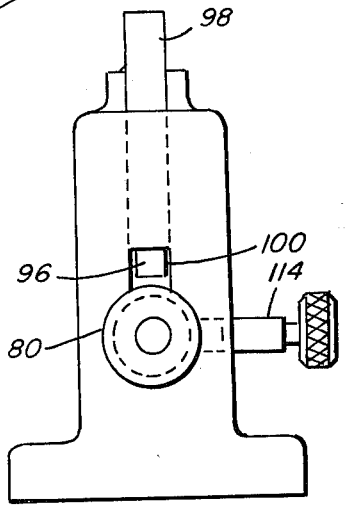
FIG. 7
FIG. 8
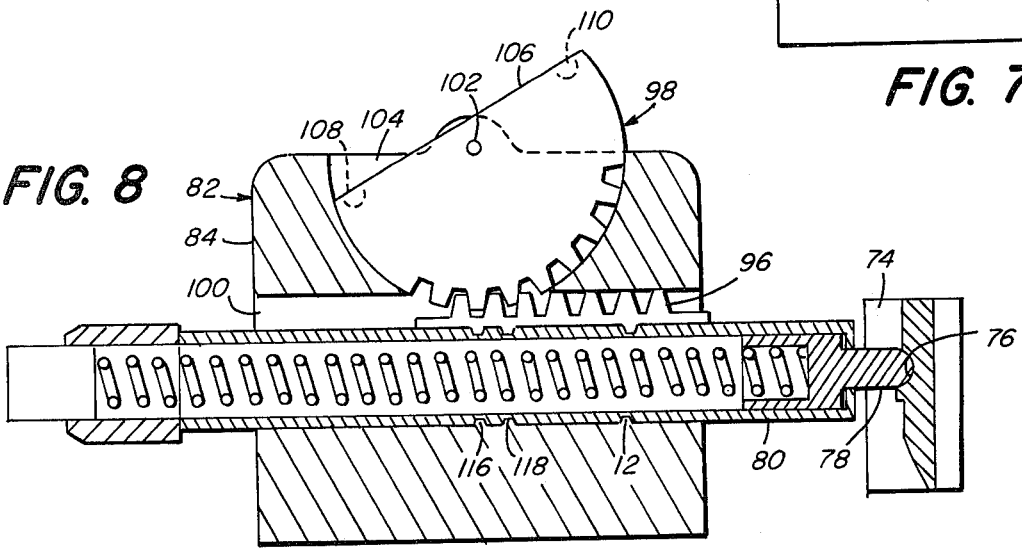
FIG. 6
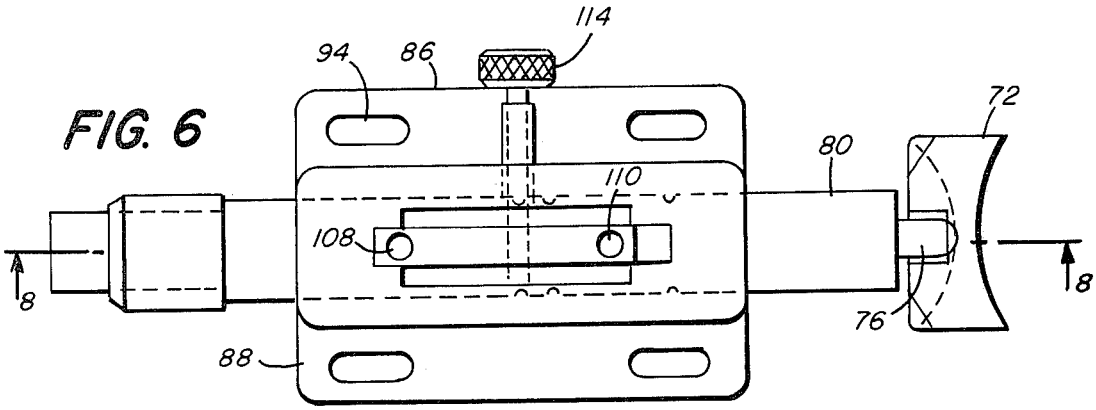

HEEL BINDING FOR CROSS-COUNTRY SKIS

BACKGROUND OF THE INVENTION

1. Field of the Invention

This invention relates generally to ski binding equipment and more particularly is directed towards a new and improved heel binding device primarily for use on cross-country skis.

2. Description of the Prior Art

The equipment used for cross-country skiing differs somewhat from the equipment used for downhill skiing. For downhill skiing, the boot used has a very stiff sole that is rigidly attached to the ski itself in a manner which does not allow any relative movement between the boot and the ski, although a release capability is usually provided to prevent or reduce injury in the event of a fall. However, in cross-country skiing, the boot used is quite flexible and normally only the toe portion or forward part of the boot sole is firmly attached to the ski, the heel portion being free to move up and down as the skier moves along. The boot sole is about as flexible as that in a standard shoe and the cross-country skier is able to move with a longer stride since the heel lifts up and down freely as he skis.

While this type of binding has been standard for cross-country ski equipment, many conditions may be encounted during cross-country skiing where it would be desirable to have the boot fastened to the ski in a manner similar to that of a conventional downhill boot and binding arrangement.

Accordingly, it is an object of the present invention to provide ski binding equipment for use primarily on cross-country skis which allow quick and easy conversion of the binding arrangement from a condition of a conventional cross-country binding to a condition similar to a downhill binding and to a third intermediate limited movement condition.

Another object of this invention is to provide ski binding equipment which allows quick and easy alteration of the binding connection between the boot and the ski according to the conditions encountered.

SUMMARY OF THE INVENTION

This invention features ski binding equipment for use primarily on cross-country skis and boots, comprising a plate attached to or integral with a cross-country ski boot at the heel thereof and a multi-position restraining mechanism mounted to the ski directly behind the heel of the boot. The plate is formed with a vertical groove and a rearwardly facing medial socket. The restraining mechanism includes a spring-loaded plunger that is movable to and away from the plate for selectively engaging the socket to lock the boot immobile against the ski, to engage only the groove to allow vertical movement only of the heel or to fully disengage the boot heel for maximum boot movement. The toe portion of the boot remains engaged with the ski in the usual manner.

BRIEF DESCRIPTION OF THE DRAWINGS

FIG. 5 is a view in perspective showing a modification of the invention, FIG. 6 is a top plan view thereof, FIG. 7 is an end elevation thereof, and, FIG. 8 is a cross-sectional view taken along the line 8—8 of FIG. 6.

DETAILED DESCRIPTION OF THE PREFERRED EMBODIMENT

Figure 1:
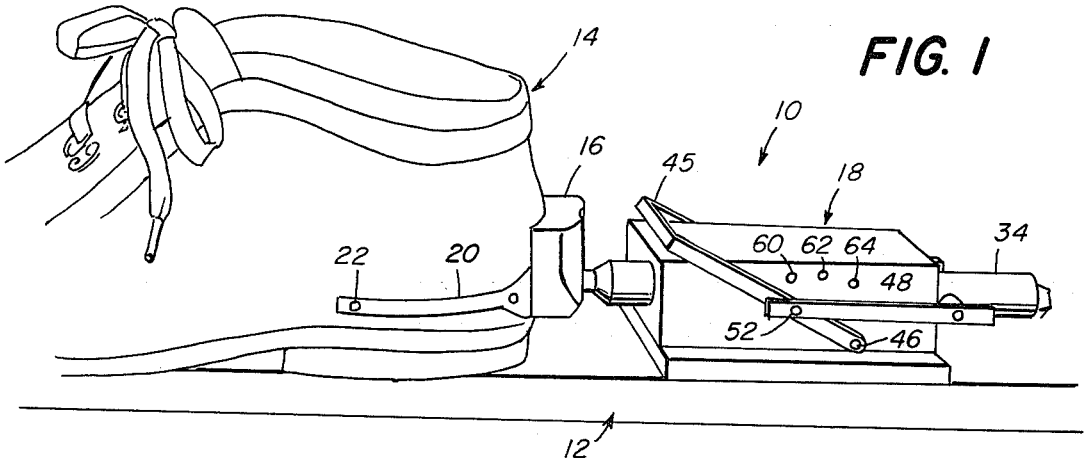
FIG. 1 is a view in perspective showing ski binding equipment made according to the invention.
Figure 2:
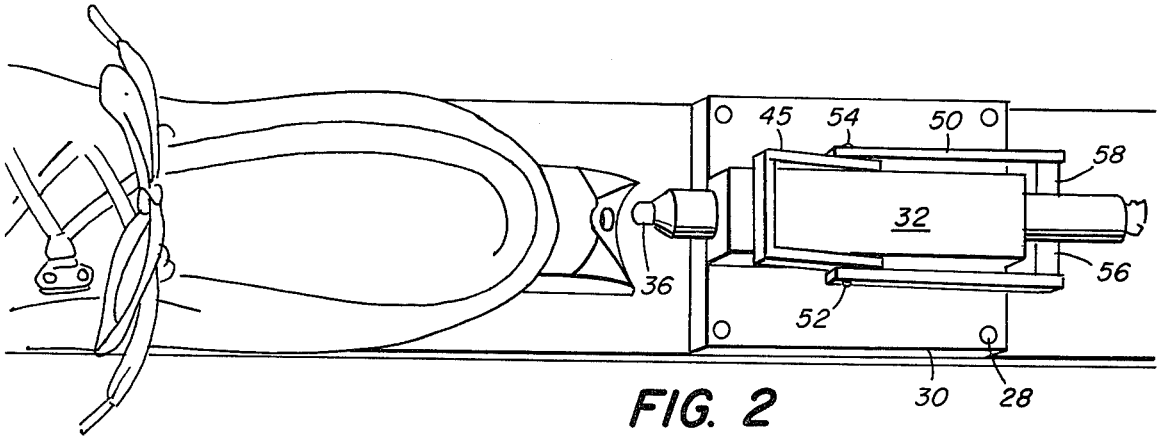
FIG. 2 is a top perspective view of the FIG. 1 equipment.
Figure 3:
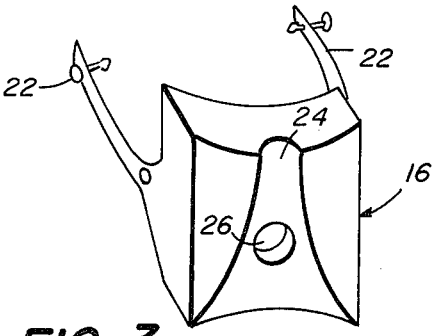
FIG. 3 is a view in perspective showing the heel plate portion of the binding.
Figure 4:
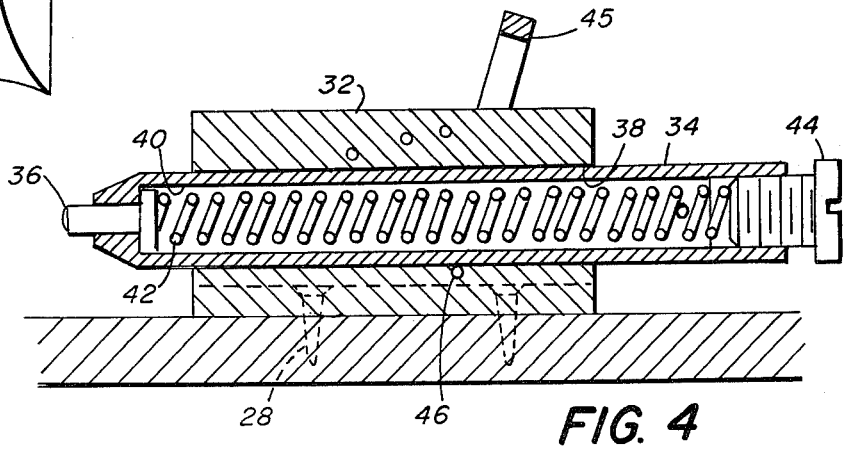
FIG. 4 is a sectional view in side elevation showing details of the multi-position restraining mechanism.

Referring now to the drawings, the reference character 10 generally indicates a binding device for use between a ski 12 and a boot 14. The device is primarily intended for use on cross-country skis and cross-country ski boots which, as previously indicated, are of a somewhat different character than conventional downhill skis and boots. Specifically, the skis tend to be somewhat thinner and longer than downhill skis and the boots typically are somewhat shorter and much more flexible than a downhill ski boot.

The device 10 generally includes a plate 16 secured to the rear of the boot just above the heel and an adjustable restraining mechanism 18 on the ski. In the illustrated embodiment the plate 16 is mounted to the boot by means of forwardly extending tabs 20 spanning the sides of the heel portion of the boot and secured in place by suitable fasteners such as rivets 22 or the like. The plate may be fabricated from a variety of different materials although, in practice, a moldable plastic material such as polyethylene, nylon, or the like, is preferred. While the plate is shown and described as a separate component mounted to the boot, obviously the plate could be made as an integral part of the boot. The plate 16 is characterized by a rearwardly facing vertical groove 24 which is wider at the base than at the top and is somewhat curved in cross-section to form a smooth, rounded groove. Approximately at the center of the groove there is formed a rearwardly facing socket or indent 26. The function of both the groove and indent will be set forth below.

The restraining mechanism 18 is generally organized about a base flange 30 secured to the upper face of the ski 12 by suitable fastening means such as screws 28 extending therethrough. The base flange 30 typically has a width generally corresponding to that of the ski to which it is mounted. Extending longitudinally along the top face of the base flange 30 is a block 32 in which is movably mounted a plunger 34, preferably of cylindrical configuration. The plunger extends slidably through the block 32 longitudinally of the ski with opposite ends projecting from both ends of the block, as shown. The forward end of the plunger is provided with a spring-loaded tip 36 of a size adapted to fit smoothly into the socket 26 in the heel plate 16. The height of the plunger and the tip is such that, when the tip 36 is seated in the socket 26 of the heel plate, the heel of the boot will be flat against the top face of the ski, as best shown in FIG. 1. In this position the boot is locked to the ski in a manner similar to that of a conventional downhill boot and ski. If the plunger is retracted slightly so that the tip 36 clears the socket 26 but does not clear the groove 24, the heel of the boot is free to move up and down vertically but is restrained against lateral movement by virtue of the sliding engagement between the groove 24 and the plunger tip 36. With the plunger fully withdrawn, the heel of the boot is free and clear and functions in the normal fashion of a conventional cross-country boot in which only the toe portion is secured to the ski.

The block 32 is formed with a longitudinal cylindrical passage 38 slidably receiving the plunger 34. The plunger 34 is also formed with an internal longitudinal passage 40 containing a compression spring 42, the forward end of which engages an enlarged rear face of the tip 36 which extends through the forward end of the plunger. The rearward end of the spring engages an adjustment screw 44 threaded to the rear of the plunger. By selective adjustment of the screw 44 the tension of the spring can be increased or decreased, as desired. The function of the spring is to provide a yielding engagement between the tip 36 and the heel plate so that in the event of a fall, for example, the heel plate will release from the restraining mechanism 18 in order to avoid injury to the skier.

The position of the plunger 34 with respect to the block and the heel plate is provided, in the illustrated embodiment, by means of a linkage arrangement comprised of a lever handle 45, the lower ends of which are pivoted to the block 32 by means of a pivot pin 46 extending through the block. Parallel connecting links 48 and 50 pivotally engage the legs of the lever handle at points between the pivot pin 46 and the cross-over portion of the handle by means of pins 52 and 54. The rearward ends of the links 48 and 50 pivotally engage the rear portion of the plunger 34 by means of outwardly projecting bosses 56 and 58 extending from opposite sides of the plunger, as shown.

Spring-loaded detent stops 60, 62, 64 are provided along the sides of the block for locking the handle 45 at any angular position. In the embodiment illustrated in FIG. 1, the handle is fully forward and restrained by the detent stop 60. In this position the plunger is pulled towards its maximum foward position for locking engagement of the tip 36 with the socket 26 in which position the boot is held fast to the ski. By pulling back on the handle 45 to the intermediate stop 62 the plunger is partly retracted and the tip 36 disengages the socket but rides in the groove 24 to allow vertical movement of the heel without lateral movement thereof. By pulling the handle 45 back to the detent stop 64, the plunger is fully retracted to permit complete freedom of the boot at the heel.

Referring now to FIGS. 5 through 8, there is illustrated a modification of the invention, and, in this embodiment. The heel plate 72 is provided with a vertical groove 74 in the outer face thereof facing rearwardly and an indent 76 is formed medially in said groove to receive a spring-loaded tip 78 mounted on the forward end of a plunger 80 carried by a block 82. The block 82 is comprised of an upright body portion 84 having a pair of base flanges 86 and 88 by means of which the block is fastened to a ski 90 as by screws 92 or the like passing through slots 94 in the flanges and driven into the ski 90. The block is positioned rearwardly of the boot 70 on the top face of the ski in the manner illustrated. The plunger 80 and tip 78 provide the same function as the plunger 34 and tip 36 of the principal embodiment, namely, to be moved into one of several different positions according to skiing condition encountered by the skier. As before, the forward position of the plunger drives the tip 78 into the indent 76 to lock the boot flat against the ski as shown in FIG. 5. In a slightly retracted position, the tip 76 clears the indent 76 but moves into the groove 74 allowing vertical movement only of the boot within the range of the slot. In the fully retracted position, the tip 78 clears the groove 74 to allow maximum movement of the boot 70.

The position of the plunger 80 is controlled by means of a rack 96 and pinion 98. In the illustrated embodiment the rack 96 is mounted to the plunger 80 extending lengthwise along the top portion thereof. The plunger 80 with the rack 96 are slidably mounted to the block 84 in a passage 100 having a cross-section of an inverted key hole extending lengthwise of the block. The pinion is an arcuate gear sector pivoted to a pin 102 extending across the upper portion of the block 84. The block 84 is formed in the top face thereof with arcuate recess 104 in which the pinion 98 is mounted to allow for angular movement of the pinion 98 about the pin 102. As best shown in FIG. 8, the pinion 98 is formed with a flat face 106 defining a chord of the gear section and includes spaced indents 108, 110 near the outer ends of the face 106. By pushing down on either side of the face 106, the gear sector 98 will be rotated clockwise or counter clockwise and, being in mesh with the rack 96, will cause the plunger 80 to move to the left or to the right according to whatever operative position is desired. The function of the indents 108 and 110 is to allow for quick adjustment of the pinion by means of a ski pole 112 as suggested in FIG. 5. The skier can simply place the point of the ski tip in indent 108 or 110 depending upon the plunger position desired and then press down in order to turn the pinion and move the plunger.

In order to lock the plunger in one of several different operating positions, a plunger locking arrangement is provided. This is comprised of a clamping screw 114 threaded into the side of the block body 84 and is formed with a pointed inner tip to engage one of several annular grooves 116, 118 and 120 formed in spaced relation along the outer surface of a plunger 80. Thus, if the skier desires to lock the plunger in position, he merely loosens the screw 114 slightly, moves the plunger into the desired operating position in which the appropriate annular groove will align with the locking screw and then tightens the screw to lock the plunger in place. In practice, the locking screw is located on the outside face of the block corresponding to the right or left hand ski to make it more conveniently accessible to the skier.

While the invention has been described with particular reference to the illustrated embodiments numerous modifications thereto will appear to those skilled in the art. For example, in place of the lever handle and plunger mechanism for moving the detent with respect to the heel plate, other mechanisms may be employed. One such mechanism might be a movable cam used in conjunction with a detent in such a manner that movement of the cam will also move the detent in and out engagement with the plate. Such a cam can be pivoted to the ski and drivingly engage a detent device slidably mounted in a supporting block. Alternatively, various other eccentric latching mechanisms may be used. Even a simple screw device may be employed for advancing and retracting the detent with respect to the plate. Thus, instead of the reciprocating plunger in the illustrated embodiment, the entire plunger might be threaded to the block. By rotating the plunger one way or another it would be moved in and out of the block although at a rate somewhat slower than that the mechanism illustrated. Numerous other modifications thereto will appear to those skilled in the art.

Having thus described the invention, what I claim and desire to claim by Letters Patent of the United States is:

1. Apparatus for binding a boot to a ski, comprising
(a) a heel plate for mounting to the rear part of said boot, and,
(b) a multi-position mechanism for mounting to the upper face of said ski rearwardly of said boot,
(c) said plate being formed with a rearwardly facing groove and an indent therein, said groove extending in a direction generally upwards from the heel of said boot along the back thereof when said plate is on said boot,
(d) said mechanism including a detent and means for moving said detent selectively from a position of engagement with said indent to a position of engagement only with said groove to a position disengaged from said plate whereby the heel portion of said boot will be, respectively, locked against said ski, free to move only in a direction generally perpendicular to the top face of said ski and freely movable.

2. Apparatus according to claim 1 wherein said plate is an integral portion of said boot.

3. Apparatus according to claim 1 wherein said plate includes fastening means for mounting said plate to said boot.

4. Apparatus according to claim 1 wherein said moving means includes a member supporting said detent and movable therewith, said member having a plurality of stop positions.

5. Apparatus according to claim 1 wherein said detent is resiliently mounted to said mechanism whereby said detent will release from said plate in the event of excess pressure therebetween.

6. Apparatus according to claim 1 wherein said mechanism includes a base adapted to be mounted in a relatively fixed position to said ski, a plunger mounted to said base for limited movement lengthwise of said ski and handle means connected to said base and to said plunger for moving said plunger with respect to said base, said detent being mounted to said plunger.

7. Apparatus according to claim 6 including resilient means mounted to said plunger and engaging said detent.

8. Apparatus according to claim 7 including tension adjusting means engaging said resilient means for selectively adjusting the tension thereof.

9. Apparatus according to claim 6 wherein said handle means includes a lever pivoted at one end to said base and a link connected to said lever and to said plunger, and indexing means mounted to said base and engageable with said lever to provide multiple stop positions for said lever.

10. Apparatus according to claim 1 wherein said moving means includes a rack drivingly connected to said detent and mounted for longitudinal movement parallel to the path of travel of said indent, and a pinion in mesh with said rack, said pinion mounted about an axis perpendicular to said rack whereby angular movement of said pinion will move said rack and said detent to a selected position with respect to said heel plate.

11. Apparatus according to claim 10 wherein said pinion is semi-circular and formed with a flat face defining a chord, said flat face being distal to said rack and exposed for manual contact.

12. Apparatus according to claim 11 wherein said flat face is formed with spaced indents one at each end of said face for engaging the tip of a ski-pole placed thereagainst.

13. Apparatus according to claim 10 wherein said mechanism includes a base adapted to be mounted in a relatively fixed position to said ski, a plunger mounted to said base for limited motion lengthwise of said ski, said detent being mounted to the forward end of said plunger, said rack being mounted lengthwise along said plunger.

14. Apparatus according to claim 13 wherein said plunger is formed with longitudinally spaced shoulders and a locking screw is threaded to said base perpendicular to said plunger and selectively engageable with said shoulders for locking said plunger in position.

* * * * *